US008317547B2

(12) United States Patent
Riner et al.

(10) Patent No.: US 8,317,547 B2
(45) Date of Patent: Nov. 27, 2012

(54) ELECTRICAL DISTRIBUTION BLOCK APPARATUS AND METHOD OF ASSEMBLY

(75) Inventors: Raymond H. Riner, Fort Wayne, IN (US); Bradley Plattner, Kendallville, IN (US)

(73) Assignee: Group Dekko, Inc., Garrett, IN (US)

( * ) Notice: Subject to any disclaimer, the term of this patent is extended or adjusted under 35 U.S.C. 154(b) by 0 days.

(21) Appl. No.: 13/040,107

(22) Filed: Mar. 3, 2011

(65) Prior Publication Data

US 2011/0217863 A1 Sep. 8, 2011

Related U.S. Application Data

(60) Provisional application No. 61/310,470, filed on Mar. 4, 2010.

(51) Int. Cl.
*H01R 4/60* (2006.01)

(52) U.S. Cl. ..... 439/687; 439/215

(58) Field of Classification Search ..... 439/687, 439/215, 686

See application file for complete search history.

(56) References Cited

U.S. PATENT DOCUMENTS

| | | | | |
|---|---|---|---|---|
| 2,686,297 | A * | 8/1954 | Hutt | 439/107 |
| 3,273,105 | A * | 9/1966 | Klassen | 439/687 |
| 4,354,719 | A * | 10/1982 | Weidler | 439/598 |
| 5,199,889 | A * | 4/1993 | McDevitt, Jr. | 439/66 |
| 5,203,713 | A * | 4/1993 | French et al. | 439/215 |
| 5,503,565 | A * | 4/1996 | McCoy | 439/171 |
| 7,008,249 | B2 * | 3/2006 | McCoy et al. | 439/215 |
| 7,077,708 | B1 * | 7/2006 | Johnson et al. | 439/687 |
| 7,410,379 | B1 * | 8/2008 | Byrne | 439/215 |
| 7,465,178 | B2 * | 12/2008 | Byrne | 439/215 |
| 7,544,076 | B2 * | 6/2009 | Lubkert | 439/215 |
| 7,905,737 | B2 * | 3/2011 | Byrne | 439/215 |

* cited by examiner

*Primary Examiner* — Gary F. Paumen
(74) *Attorney, Agent, or Firm* — Taylor IP, P.C.

(57) ABSTRACT

An electrical receptacle includes a first portion having a face with a plurality of openings and including a first set of protrusions and a first set of receptors, the first portion being configured to receive a plurality of electrical conductors, and a second mating portion including a second set of protrusions and a second set of receptors. The first set of receptors is configured to interact with the second set of protrusions and the first set of protrusions is configured to interact with the second set of receptors to snap lock the second mating portion to the first portion and form the electrical receptacle. Further, a method is provided for assembling and disassembling an electrical receptacle.

8 Claims, 3 Drawing Sheets

ELECTRICAL DISTRIBUTION BLOCK APPARATUS AND METHOD OF ASSEMBLY

CROSS REFERENCE TO RELATED APPLICATIONS

This is a non-provisional application based upon U.S. provisional patent application Ser. No. 61/310,470, entitled "ELECTRICAL DISTRIBUTION BLOCK APPARATUS AND METHOD OF ASSEMBLY", filed Mar. 4, 2010, which is incorporated herein by reference.

BACKGROUND OF THE INVENTION

1. Field of the Invention

The present invention relates to an electrical distribution block apparatus, and, more particularly, to an electrical receptacle.

2. Description of the Related Art

Electrical power is distributed by networks of electrical conduits that terminate in electrical outlet boxes where the electrical power is accessed. Power from the electrical conduits is connected in the outlet boxes to electrical receptacles positioned on the boxes. The electrical receptacles have slots and apertures for receiving prongs of appliances and to connect to other electrical devices. Such networks are used in residential and commercial construction, as well as, in mobile structures such as trailers and motor homes.

Modular outlet receptacles may be included in modular office partitions and they provide flexibility in terms of system layout and interconnectability to other components of the electrical system. Typically, such a modular electrical receptacle includes at least one connector, which is adapted to interface with a corresponding connector or wiring harness. A wiring harness typically includes electrical connectors at opposing ends thereof, which extend to another component of the electrical system such as another electrical receptacle. The connector of the electrical receptacle also includes contacts, which are electrically connected to each of line, neutral and ground conductors disposed within the modular electrical receptacle.

It is known to use cold formed heat staking to attach or fixedly assemble the components of an electrical receptacle. Staking is a process that is utilized to interconnect a number of components. One component is provided with studs, which protrude through holes in the other part. The studs are then deformed through the cold flow or melting of the plastic to form a head which mechanically locks the two components together. This method of interconnecting the components is, however, limited by size constraints.

What is needed in the art is an electrical receptacle that may be quickly easily assembled and disassembled.

SUMMARY OF THE INVENTION

The present invention provides an electrical distribution block, more specifically an electrical receptacle, and a method of assembly of same.

The electrical distribution block or electrical receptacle includes a first portion having a face with a plurality of openings and a second matting portion. The first portion includes at least one, for example a plurality of, protrusions and at least one, for example a plurality of receptors and is configured to receive a plurality of electrical conductors. The second mating portion also includes at least one protrusion, for example a plurality of protrusions, and at least one receptor, for example a plurality of receptors. The receptor(s) of the first portion are configured to interact with the protrusion(s) of the second mating portion and the protrusion(s) of the first portion are configured to interact with the receptor(s) of the second portion to snap lock the second mating portion to the first portion and form the electrical receptacle. The positioning of the protrusions of each of the first portion and the second mating portion and the receptacles of the first portion and the second mating portion serve to orient the first portion and the second portion such that assembly can only be accomplished properly.

The first portion of the electrical receptacle may include a number of positioning cavities configured to receive, for example, electrical conductors. At least one electrical conductor may extend longitudinally from a first positioning cavity to a second positioning cavity. The electrical conductors may further be configured to provide an electrical connection proximate to the openings in the face of the first portion.

According to one embodiment of the present invention, at least one fastener, for example two fasteners, is provided for a second, more robust, fastening of the first portion to the second portion. Any number of fasteners may, however, be utilized, limited only by size constraints of the receptacle. The fasteners may be, for example, screws or any of a number of known fasteners.

The present invention further provides a method for assembling an electrical receptacle, including the steps of providing a first portion and a second mating portion. The first portion has a face with openings extending therethrough and a number of protrusions and receptors. The second mating portion also includes a number of protrusions and receptors, the protrusions of the first portion being configured to interact with the receptors of the second mating portion and the receptors of the first portion configured to interact with the protrusions of the second mating portion. At least one electrical conductor is positioned within the first portion of the receptacle and the respective protrusions and associated receptors are aligned such that compression of the first portion against the second portion results in a coupling of the first portion with the second portion. A number of electrical connections may be formed by the electrical conductors proximate to the openings in the face of the first portion to provide a power source for electrical devices.

The method of the present invention may further include the step of forming a secure connection between the first and second portion utilizing at least one fastener, for example two fasteners. The fasteners may include, for example, screws.

Advantageously, the present invention provides a mechanism for detachably interconnecting two components of an electrical receptacle such that the device may be easily and efficiently assembled and disassembled.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention and such exemplification is not to be construed as limiting the scope of the invention in any manner.

DETAILED DESCRIPTION OF THE INVENTION

Figure 1:
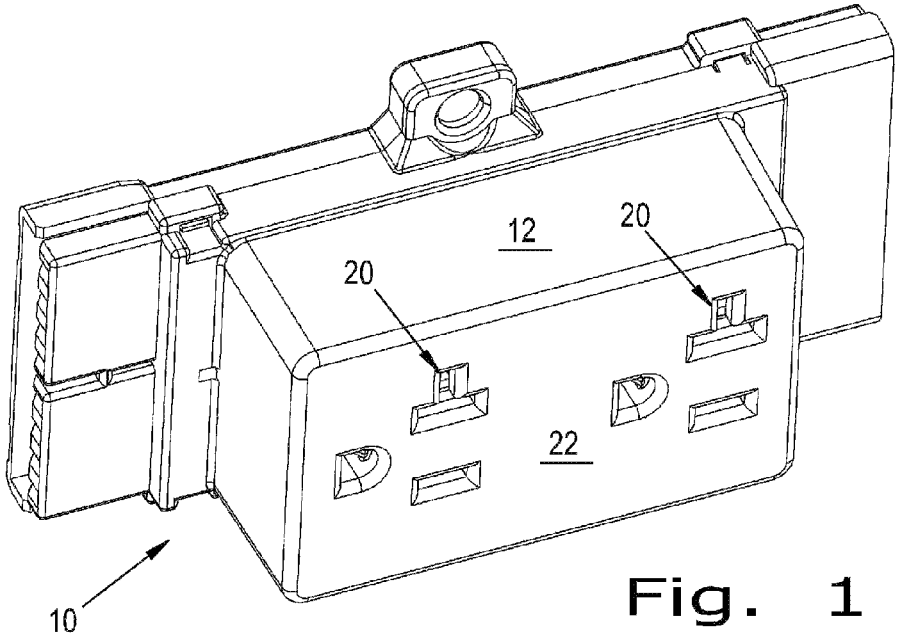
FIG. 1 is a front perspective view of an embodiment of an electrical receptacle according to the present invention.
Figure 2:
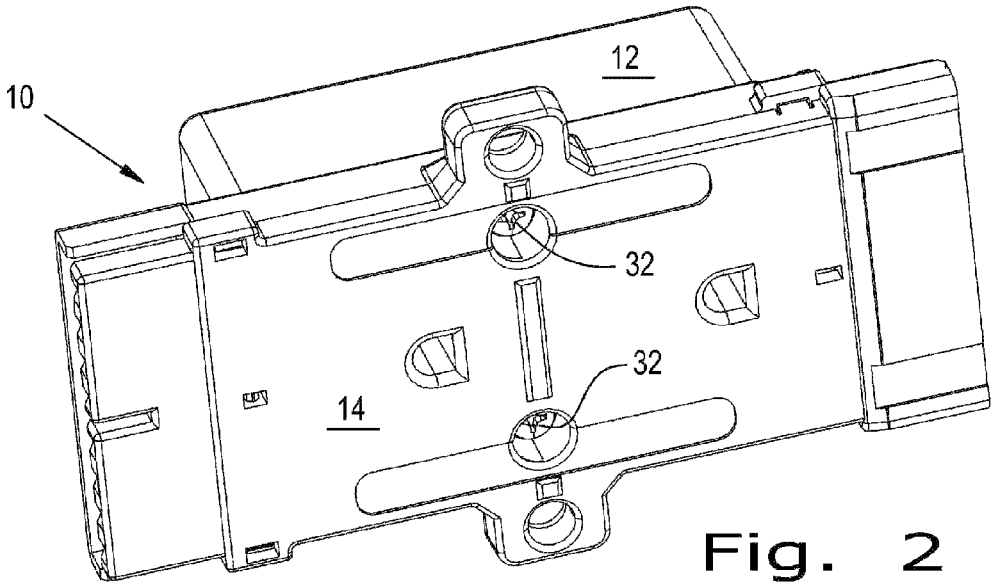
FIG. 2 is a rear perspective view of the electrical receptacle of FIG. 1.
Figure 3:
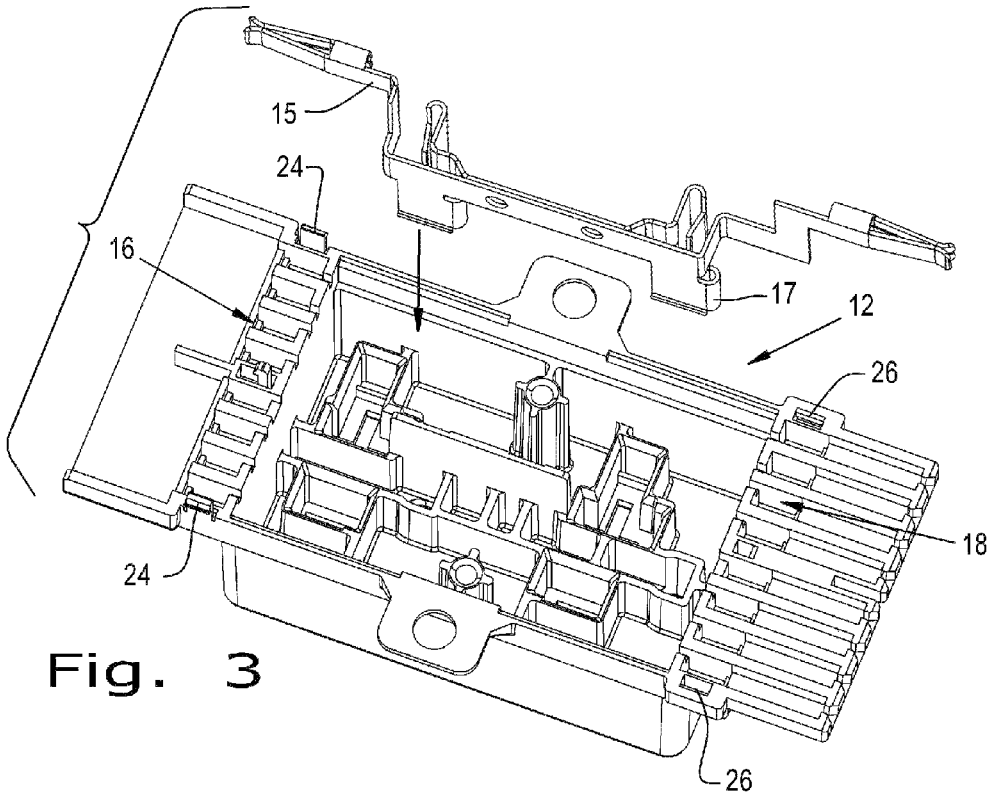
FIG. 3 is a rear perspective view of a first portion of the electrical receptacle of FIGS. 1 and 2.
Figure 4:
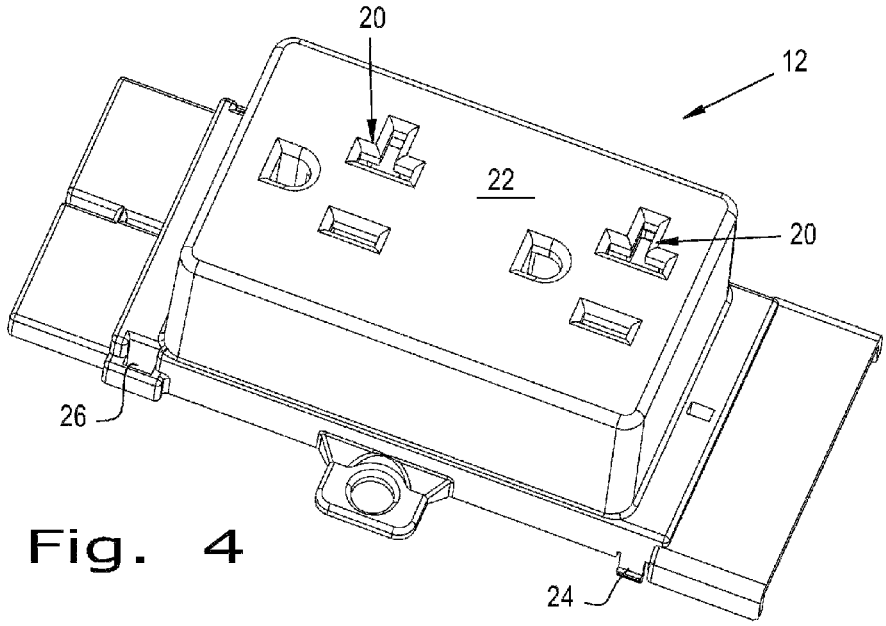
FIG. 4 is a front perspective view of a first portion of the electrical receptacle of FIGS. 1, 2 and 3.
Figure 5:
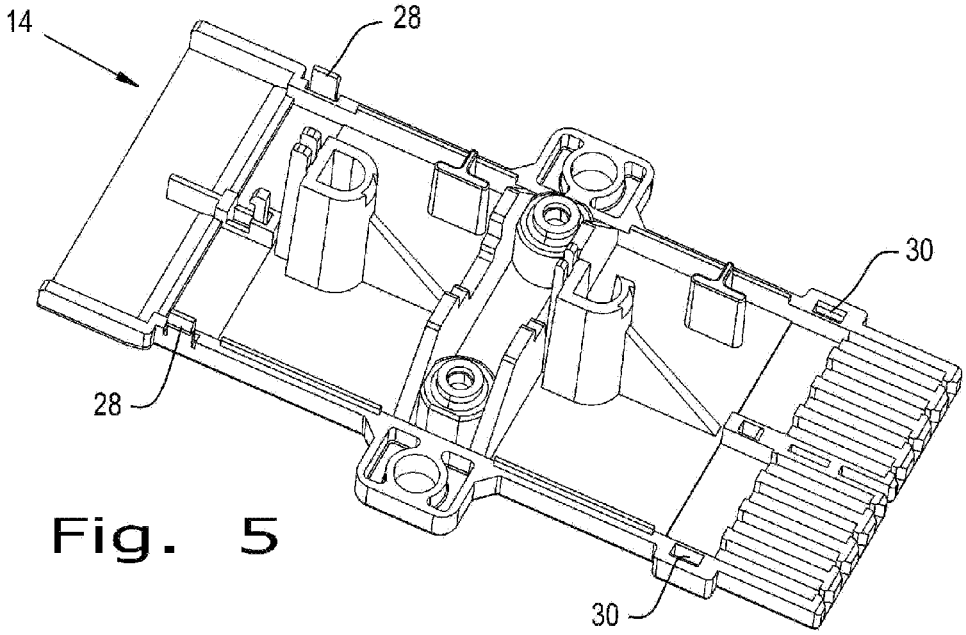
FIG. 5 is a front perspective view of a second portion of the electrical receptacle of FIGS. 1 and 2.
Figure 6:
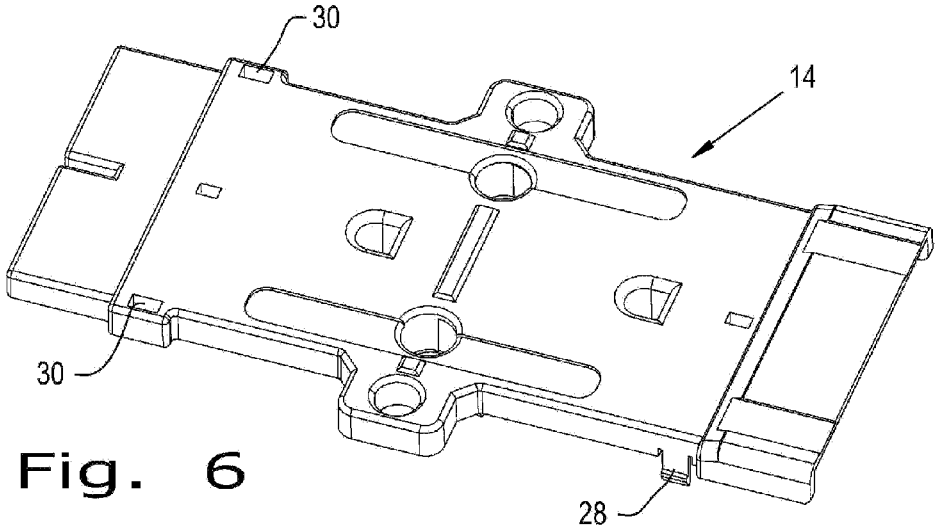
FIG. 6 is a rear perspective view of a second portion of the electrical receptacle of FIGS. 1, 2 and 5.

Referring now to the drawings and more particularly to FIGS. 1-6, there is illustrated an electrical distribution block 10, in the form of an electrical receptacle 10. Receptacle 10 has a first portion 12 and a mating second portion 14, which are attached together to form receptacle 10. During the assembly process electrical conductors 15 are positioned in portion 12, which can be understood by looking at FIG. 3. Only one electrical conductor 15 is shown for the sake of clarity, although typically several conductors 15 of various configurations may be utilized in receptacle 10. At least one electrical conductor 15 may extend from a positioning cavity 16 to another positioning cavity 18, and may be configured to provide electrical connections 17 proximate to openings 20 in face 22.

Once the electrical conductors 15 are positioned in portion 12, portion 14 is aligned and pressed together with portion 12. Portion 12 includes protrusions 24 and receptors 26. In a similar manner portion 14 includes protrusions 28 and receptors 30. Protrusions 24 interact with receptors 30; and protrusions 28 interact with receptors 26 to snap lock portions 12 and 14 together. The positioning of protrusions 24 and 28, and receptors 26 and 30, serve to orient portions 12 and 14 to each other so that assembly can only be accomplished properly.

Although the above describes the assembly of portions 12 and 14 with electrical conductors enclosed, the connection is temporary and would not withstand the rigors of subsequent use. While it is advantageous to initially assemble receptacle 10 in this manner, a second more robust fastening of portion 12 to portion 14 is undertaken to ensure the integrity of receptacle 10. While the more robust connection can take many forms it is illustrated in the drawings as two fasteners 32, such as screws 32. It is also contemplated to use different numbers of fasteners, or to even use added features of portions 12 and/or 14 to secure portions 12 and 14 together in this subsequent fastening step.

The present invention has several advantages over the prior art which utilized cold formed heat staking to attach the portions. In the present invention portions 12 and 14 snap together, thereby allowing easy assembly and disassembly if needed. Additionally, the present invention allows for simplicity in the tooling that assembles portions 12 and 14. Yet further the present invention bolsters the robustness of the assembly with a second connection step.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical receptacle comprising:

a first portion having a face with a plurality of openings and including a first set of protrusions and a first set of receptors, said first portion being configured to receive a plurality of electrical conductors;

a second mating portion including a second set of protrusions and a second set of receptors, said first set of receptors configured to interact with said second set of protrusions and said first set of protrusions configured to interact with said second set of receptors temporarily connecting said second mating portion to said first portion and form the electrical receptacle; and at least one fastener configured to securely couple said first portion with said second portion, said at least one fastener being a screw.

2. The electrical receptacle according to claim 1, wherein said first portion includes a plurality of positioning cavities configured to receive said plurality of electrical conductors.

3. The electrical receptacle according to claim 2, wherein said plurality of electrical conductors are configured to provide an electrical connection proximate to said plurality of openings of said face of said first portion.

4. The electrical receptacle according to claim 3, wherein said plurality of positioning cavities include a first positioning cavity and a second positioning cavity, at least one of said plurality of electrical conductors extending between said first positioning cavity and said second positioning cavity.

5. A method of assembling an electrical receptacle, the method comprising the steps of:

providing a first portion having a face with a plurality of openings and including a first set of protrusions and a first set of receptors;

providing a second mating portion including a second set of protrusions and a second set of receptors;

positioning at least one electrical conductor within said first portion;

aligning said first set of protrusions with said second set of receptors and said second set of protrusions with said first set of receptors;

pressing said first portion against said second portion temporarily connecting said first portion with said second mating portion; and forming a secure connection between said first portion with said second portion with at least one fastener, said at least one fastener being a screw.

6. The method according to claim 5, further comprising the step of extending said at least one electrical conductor between a first positioning cavity and a second positioning cavity of said first portion.

7. The method according to claim 6, positioning a plurality of electrical connections of said at least one electrical conductor proximate to said plurality of openings of said face.

8. The method according to claim 5, wherein said at least one fastener is two fasteners.

* * * * *